US010925340B2

(12) United States Patent
Brandt et al.

(10) Patent No.: US 10,925,340 B2
(45) Date of Patent: Feb. 23, 2021

(54) HOOD SYSTEM FOR A GARMENT

(71) Applicant: NIKE, Inc., Beaverton, OR (US)

(72) Inventors: Baron C. Brandt, Portland, OR (US); Karey Cruz, Portland, OR (US)

(73) Assignee: NIKE, INC., Beaverton, OR (US)

( * ) Notice: Subject to any disclaimer, the term of this patent is extended or adjusted under 35 U.S.C. 154(b) by 77 days.

(21) Appl. No.: 15/960,796

(22) Filed: Apr. 24, 2018

(65) Prior Publication Data

US 2018/0343950 A1 Dec. 6, 2018

Related U.S. Application Data

(60) Provisional application No. 62/512,306, filed on May 30, 2017.

(51) Int. Cl.

| | |
|---|---|
| ***A41D 1/02*** | (2006.01) |
| ***A41D 3/02*** | (2006.01) |
| ***A42B 1/048*** | (2021.01) |

(52) U.S. Cl.

CPC ..... *A42B 1/048* (2013.01); *A41D 1/02* (2013.01); *A41D 3/02* (2013.01); *A41D 2200/20* (2013.01); *A41D 2400/10* (2013.01)

(58) Field of Classification Search

CPC . A42B 1/048; A41D 3/02; A41D 1/02; A41D 3/04; A41D 2200/20; A41D 2400/10

USPC ..... 2/93, 108, 202, 204, 207, 84

See application file for complete search history.

(56) References Cited

U.S. PATENT DOCUMENTS

| | | | | |
|---|---|---|---|---|
| 1,485,392 A * | 3/1924 | Halek | ..... | A41D 3/02 2/84 |
| 2,547,931 A | 4/1951 | De Grazia | | |
| 4,334,325 A | 6/1982 | Walkuski | | |
| 5,832,538 A | 11/1998 | Williams | | |

(Continued)

FOREIGN PATENT DOCUMENTS

| | | |
|---|---|---|
| EP | 673609 A1 | 9/1995 |
| EP | 2692258 A1 | 2/2014 |

(Continued)

OTHER PUBLICATIONS

International Search Report and Written Opinion dated Aug. 20, 2018 in International Patent Application No. PCT/US2018/034099, 14 pages.

(Continued)

*Primary Examiner* — Sally Haden
*Assistant Examiner* — Erick I Lopez
(74) *Attorney, Agent, or Firm* — Shook, Hardy & Bacon L.L.P.

(57) ABSTRACT

Aspects herein are directed to a garment having a hood system comprising an outer hood and a yoke structure positioned adjacent and internal to the outer hood. The outer hood is affixed to a neckline opening of the garment along the sides of the neckline opening but is detached from the neckline opening in the back. The yoke structure is selectively attached to the outer hood in two or more disparate locations and is affixed to the neckline opening of the garment at the location at which the outer hood is detached from the neckline opening. The hood system is useable for distributing tension forces generated by pulling the front of the outer hood forward to, for example, cover a wearer's eyes when resting.

17 Claims, 8 Drawing Sheets

(56) References Cited

U.S. PATENT DOCUMENTS

| | | | | |
|---|---|---|---|---|
| 6,370,692 | B1 | 4/2002 | Duyn et al. | |
| 6,539,553 | B2 | 4/2003 | Day | |
| 6,874,162 | B2 | 4/2005 | Boezi | |
| 7,296,302 | B2 | 11/2007 | DeLorenzo et al. | |
| 7,467,422 | B2 | 12/2008 | Bugarin | |
| 8,375,469 | B2 | 2/2013 | Duwyn-Zylstra | |
| 2006/0288465 | A1 | 12/2006 | Delorenzo et al. | |
| 2007/0118960 | A1 | 5/2007 | Goodwin | |
| 2008/0104740 | A1 | 5/2008 | Enns | |
| 2011/0131704 | A1 | 6/2011 | Hughes | |
| 2012/0131722 | A1 | 5/2012 | Kang | |
| 2014/0096305 | A1 | 4/2014 | Friesen | |
| 2014/0317829 | A1 | 10/2014 | Rolfe | |
| 2014/0338092 | A1 | 11/2014 | Kinsey | |
| 2015/0327608 | A1* | 11/2015 | Kurtzweg | A41D 27/285 2/93 |
| 2016/0029727 | A1 | 2/2016 | Chang | |
| 2016/0095359 | A1 | 4/2016 | Fox et al. | |
| 2016/0150847 | A1* | 6/2016 | Johnson | A41D 27/28 2/84 |

FOREIGN PATENT DOCUMENTS

| | | | |
|---|---|---|---|
| WO | 2006021025 | A1 | 3/2006 |
| WO | 2012083641 | A1 | 6/2012 |

OTHER PUBLICATIONS

"Connectyle Windproof Hood Hat Warm Winter Hats Polar Fleece Balaclava Skull Cap," Amazon, amazon.com, ASIN: B01LZIH6QW, Sep. 18, 2016. https://www.amazon.com/dp/B01LZIH6QW/.

"Ezyoutdoor Unisex Winter Warm Skull Cap Outdoor Windproof Fleece Earflap Hat with Removable Zippered Face Mask Balaclava for Cycling Camping Hiking Running Traveling," Amazon, amazon.com, ASIN: B01MQFRRVJ, accessed: Apr. 2017. https://www.amazon.com/Ezyoutdoor-Windproof-Removable-Balaclava-Traveling/dp/B01MQFRRVJ.

International Preliminary Report on Patentability dated Dec. 12, 2019 in International Patent Application No. PCT/US2018/034099, 9 pages.

* cited by examiner

HOOD SYSTEM FOR A GARMENT

CROSS-REFERENCE TO RELATED APPLICATIONS

This application, having U.S. patent application Ser. No. 15/960,796, filed Apr. 24, 2018, and entitled "Hood System for a Garment," claims the benefit of priority of U.S. Prov. App. No. 62/512,306, entitled "Hood System for a Garment," and filed May 30, 2017. The entirety of the aforementioned application is incorporated by reference herein.

TECHNICAL FIELD

Aspects herein relate to a hood system for a garment.

BACKGROUND

Hoods on garments are generally used to provide warmth to a wearer's head during cold weather conditions.

BRIEF DESCRIPTION OF THE DRAWINGS

Examples of the present invention are described in detail below with reference to the attached drawing figures, wherein.

DETAILED DESCRIPTION

Figure 1:
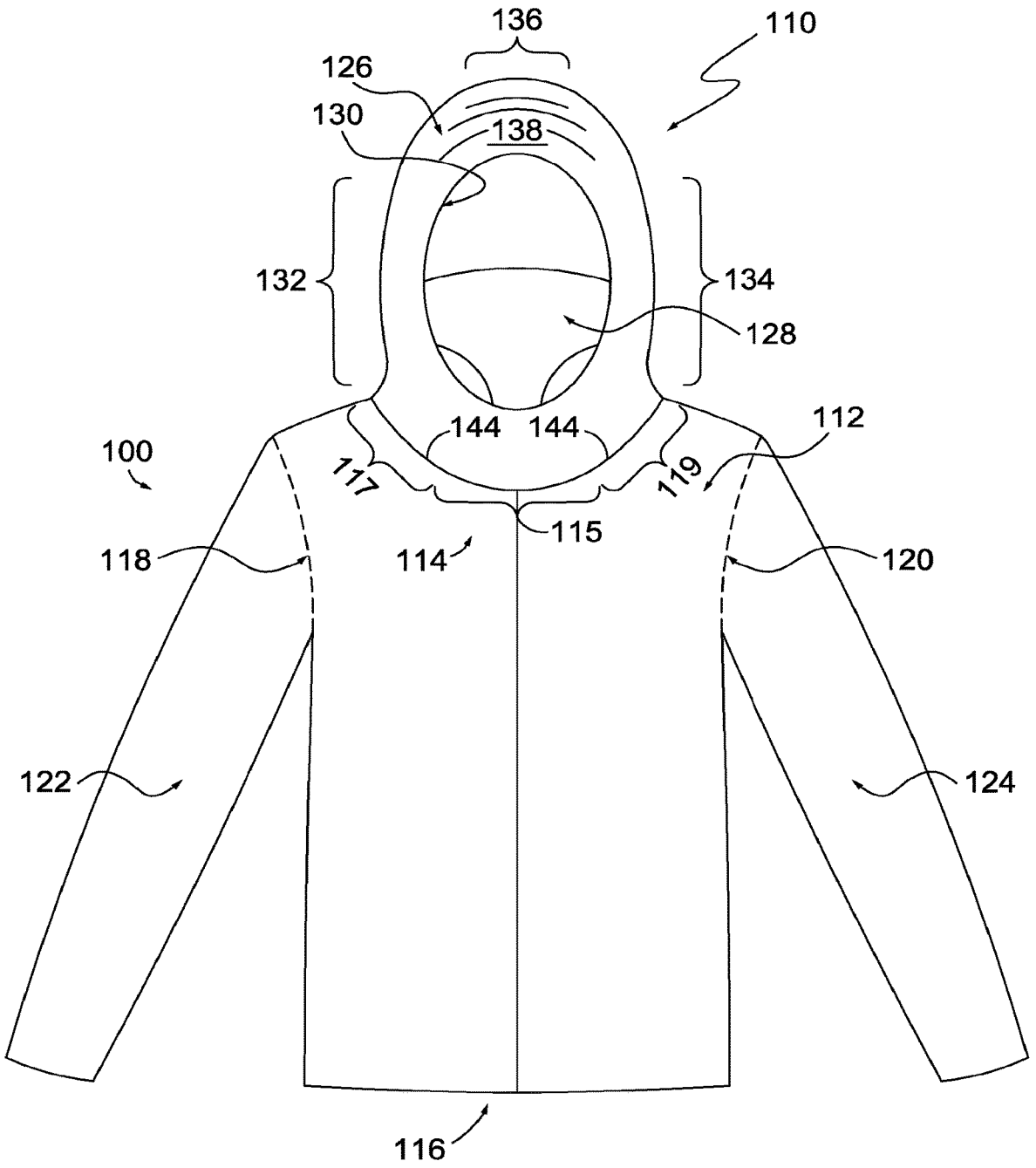
FIG. 1 illustrates a front view of a garment having an exemplary hood system in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to a hood system for a garment comprising at least an outer hood and an inner yoke structure. In exemplary aspects, the outer hood may be configured to be "over-sized" and/or to have extra volume at, for instance, the top portion of the outer hood as compared to more traditional hoods. The outer hood is affixed to a neckline opening of the garment at least along the side aspects of the neckline opening. The outer hood is unaffixed or detached from the neckline opening in the back. The yoke structure is positioned interior to the outer hood generally along a back aspect of the hood. As used throughout this disclosure, the term "yoke structure" may be defined as a shaped pattern piece which forms part of the garment and is useable to provide support for looser parts of the garment (the outer hood in this case). In exemplary aspects, the yoke structure has a "T" shape with the arm of the "T" extending horizontally along the back of the hood and along side portions of the hood, and the stem of the "T" extending vertically downward at the back of the hood when the outer hood is in a head covering position. With continued respect to the yoke structure, terminal ends of the arm of the "T" are affixed to the side portions of the outer hood, and a terminal end of the stem of the "T" is affixed to the neckline opening in the back; other portions of the yoke structure remain free-floating or unattached to the outer hood. To describe it a different way, the terminal end of the stem of the "T" is affixed to the neckline opening at the location where the outer hood is detached from the neckline opening. In exemplary aspects, the yoke structure is formed from an elastically resilient material.

This configuration provides several functional benefits. Because, for example, the top portion of the outer hood may be constructed to have extra volume and because the back of the outer hood is detached or de-coupled from the neckline opening of the garment in back, the top portion of the outer hood can be tensioned anteriorly to, for instance, cover the eyes of the wearer when resting without causing undue strain on the neckline opening and/or causing the garment to shift upward. The yoke structure, due to its attachment to the neckline opening in the back and to its attachment to the outer hood at the side portions, acts as an anchor structure allowing the top portion of the hood to be pivoted forward or tensioned forward without causing significant displacement of other parts of the outer hood. Moreover, because the yoke structure is formed from an elastically resilient material, the yoke structure can conform and expand to cover the back and sides of the wearer's head to provide a snug feel to the hood, even when the outer hood is constructed to have extra volume. Further, the elastic nature of the yoke structure minimizes the strain imparted to the neckline opening at the point of attachment of the yoke structure when the hood is pulled forward to cover the wearer's eyes. The result is a hood system that facilitates the ability of a wearer to rest by pulling the outer hood forward to cover the wearer's eyes while still retaining a snug fit to the hood and without causing undue strain on other portions of the garment.

Accordingly, in one aspect, a hood system for a garment having at least a neckline opening is provided. The hood system comprises an outer hood comprising at least a first side portion and a second side portion, a top portion adjacent to the first and second side portions, the top portion having a front aspect and a back aspect, and a back portion extending from the back aspect of the top portion and extending from the first side portion to the second side portion. The back portion and the first and second side portions define a base for the outer hood, where the base of the outer hood is affixed to the neckline opening of the garment at a first location and is unaffixed from the neckline opening of the garment at a second location. The hood system further comprises a yoke structure positioned adjacent and internal to the outer hood. The yoke structure is affixed to the neckline opening of the garment at the second location, and the yoke structure is further affixed to the first and second side portions of the outer hood.

In another aspect, a garment having a hood system is provided comprising a torso covering portion having at least a neckline opening, and an outer hood affixed to the neckline opening at a first location and unaffixed from the neckline opening at a second location. The garment further comprises a yoke structure positioned adjacent and internal to the outer hood, where the yoke structure is affixed to the neckline opening at the second location. The yoke structure is further affixed to the outer hood at least at two disparate locations.

In yet another aspect, a hood system for a garment comprising at least a neckline opening is provided. The hood system comprises an outer hood, where the outer hood is affixed to the neckline opening of the garment at a first location and is unaffixed from the neckline opening of the garment at a second location. The hood system further comprises a yoke structure positioned adjacent and internal to the outer hood. The yoke structure has a first terminal end that is affixed to a first side portion of the outer hood, a second terminal end affixed to a second side portion of the outer hood, and a third terminal end affixed to the neckline opening of the garment at the second location.

Positional terms as used herein such as "front," "back," "side," "anterior," "posterior," "top," "bottom," and the like are to be given their common meaning with respect to a hypothetical wearer standing in anatomical position with a hood of a garment in a head covering or upright position. It is assumed that the garment is being worn as intended and as described and shown herein. Terms used herein such as "affixing," "securing," "secured," and the like may mean releasably joining two or more elements together using affixing technologies such as releasable adhesives, slider mechanisms, zippers, buttons, hood-and-loop fasteners, and the like. As well, these terms may mean permanently joining two or more elements together using affixing technologies such as stitching, bonding, welding, and the like. A distinction between releasably joining and permanently joining will be provided when appropriate. The terms "elastic," or "elastically resilient" as used herein means fabrics or textiles that incorporate elastic yarns such as Spandex® to impart two-way and/or four-way stretch and recovery to the textile. By contrast, the term "non-stretch" or "low-stretch" as used herein may mean fabrics or textiles that do not incorporate elastic yarns. These textiles, however, may still exhibit some degree of mechanical stretch due to the particular knitting or weaving process used to form the fabric or textile. Further, when describing the hood system and/or garment in relation to a wearer, phrases such as "configured to cover a [specified portion] of a wearer," refer to a hood system and/or garment that is appropriately sized for the particular wearer.

Figure 2A:
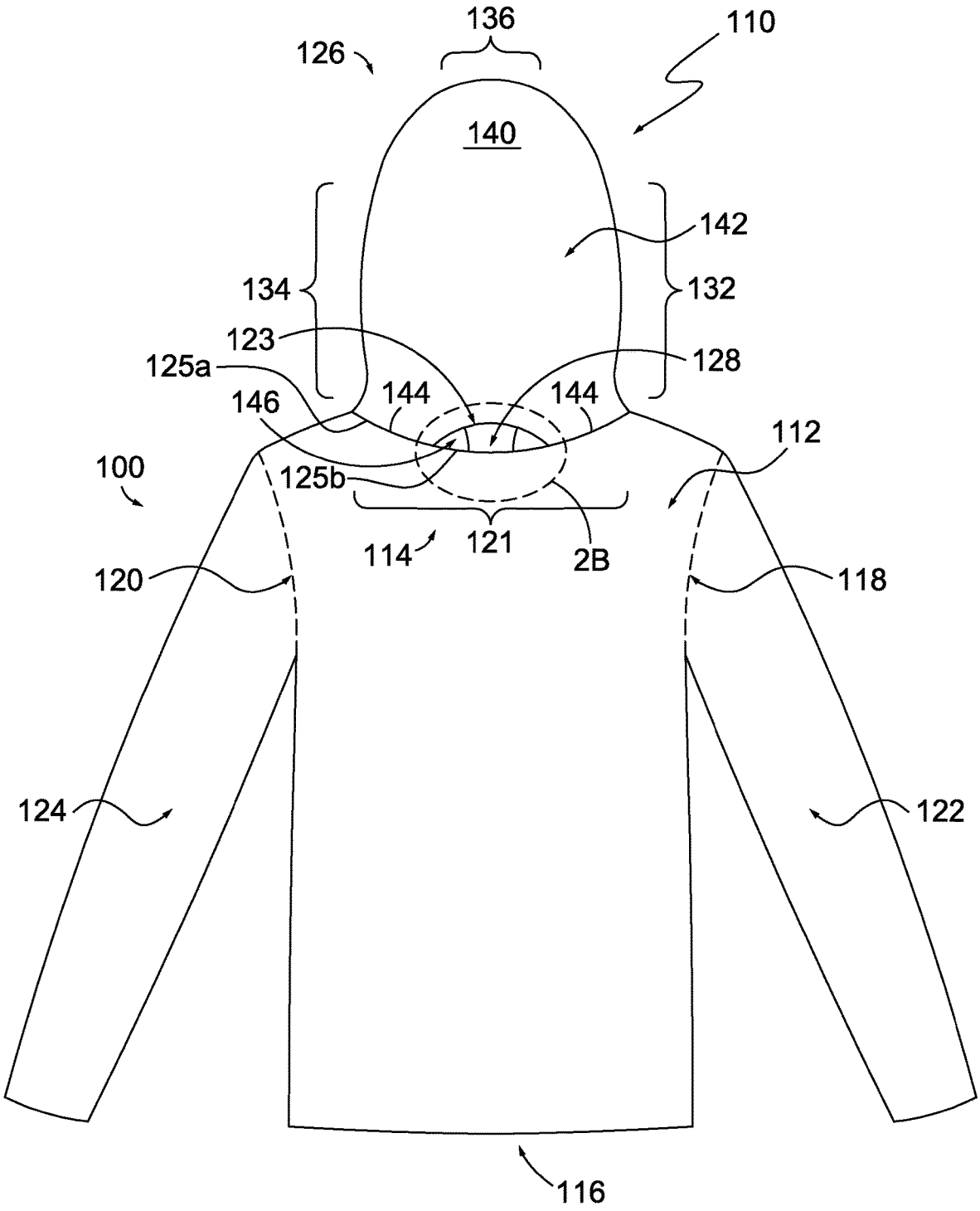
FIG. 2A illustrates a back view of the garment of FIG. 1 in accordance with aspects herein.

Turning now to FIGS. 1 and 2A, front and back views respectively of a garment 100 having an exemplary hood system 110 are illustrated in accordance with aspects herein. The garment 100, in exemplary aspects, may comprise an outer-wear garment or a garment meant to be worn over one or more other garments or layers, although it is contemplated herein that the garment 100 may comprise a stand-alone garment (i.e., a garment meant to be worn as a base layer). The garment 100, for instance, may comprise a jacket as shown, but also may be embodied in a pullover, a half-zip, and the like. Further, although shown with long sleeves 122 and 124, it is contemplated herein that the garment 100 may comprise half sleeves, one-quarter sleeves, no sleeves, and the like. In exemplary aspects, the garment 100 comprises a torso-covering portion 112 configured to cover the front and back torso areas of a wearer when the garment 100 is in an as-worn configuration. The torso-covering portion 112 defines at least a neckline opening 114, a waist opening 116, and first and second sleeve openings 118 and 120 (indicated by the dashed lines) from which the sleeves 122 and 124 extend.

The neckline opening 114 generally defines a circumferential opening when the garment 100 is in the as-worn configuration. As such, the neckline opening 114 may comprise a front aspect 115, a first side aspect 117, a second side aspect 119, and a back aspect 121 (seen in FIG. 2A) that complete the circumferential opening.

The garment 100, in exemplary aspects, may be formed from a knitted, woven, or non-woven material that exhibits low stretch, although textiles having stretch are also contemplated herein as suitable materials for forming the garment 100. In some aspects, the garment 100 may be formed from a spacer mesh material that is adapted to provide warmth and/or insulation by trapping heated air in the space between the inner and outer layers of the spacer mesh.

The hood system 110 comprises an outer hood 126 and a yoke structure 128 positioned adjacent and internal to the outer hood 126 such that it is visible through face opening 130 as shown in FIG. 1. The hood system 110 is shown in a head covering position in FIGS. 1 and 2A. In exemplary aspects, the outer hood 126 is configured to have, for instance, an extra volume of material at least at the top portion of the outer hood 126 as compared with more traditional hoods, although it is contemplated herein that the outer hood 126 may comprise a more traditional hood construction without the extra volume. Continuing, in exemplary aspects, the outer hood 126 may be formed of a material similar or the same as that used to form the garment 100 such as a knitted, woven, or non-woven material that exhibits low stretch. Although it is contemplated herein that the outer hood 126 may be formed of a stretch material. As well, the outer hood 126 may be formed from a spacer mesh material adapted to provide warmth or insulation when the outer hood 126 is in the head covering position.

In exemplary aspects, the outer hood 126 may have a first side portion 132 and a second side portion 134 configured to cover the sides of a wearer's head when the outer hood 126 is in the head covering position. The outer hood 126 further comprises a top portion 136 having a front aspect 138 (seen in FIG. 1) positioned adjacent the face opening 130 and a back aspect 140 (seen in FIG. 2A) positioned toward the back of the top portion 136 of the outer hood 126. As described above, at least the top portion 136 of the outer hood 126 may be constructed to have an extra volume of material such that when the outer hood 126 is in a head covering position but is not tensioned forward to cover the wearer's eye, the top portion 136 may comprise one or more folds of material.

Continuing, the outer hood 126 still further comprises a back portion 142 extending from the back aspect 140 of the top portion 136 and extending from the first side portion 132 to the second side portion 134. The term "portion" is used to generally describe different regions or locations on the outer hood 126. As such, it is contemplated herein that the portions 132, 134, 136, and 142 may comprise integral extensions of one another formed through a common knitting or weaving event. It is also contemplated herein that one or more of the portions 132, 134, 136, and 142 may comprise separate panels joined together to form the outer hood 126. Any and all aspects, and any variation thereof, are contemplated as being within aspects herein.

Continuing, the front aspect 138 of the top portion 136 and the first and second side portions 132 and 134 help to define the face opening 130 of the outer hood 126. The back portion 142 and the first and second side portions 132 and 134 help to define a base 144 of the outer hood 126. The base 144 generally defines a circumferential opening when the outer hood 126 is in the head covering position. In exemplary aspects, the base 144 of the outer hood 126 may be permanently or releasably affixed to the neckline opening 114 along at least the front aspect 115, the first side aspect 117 and the second side aspect 119 of the neckline opening 114. It is also contemplated herein, that the outer hood 126 may comprise an integral extension of the torso covering portion 112 of the garment 100. In other words, the outer hood 126 and the torso covering portion 112 may be created through a single knitting or weaving event such that there are no seam lines between the outer hood 126 and at least the front aspect 115, the first side aspect 117 and the second side aspect 119 of the neckline opening 114.

Continuing, the base 144 of the outer hood 126 may be unaffixed or detached from the neckline opening 114 at least at a portion of the back aspect 121 of the neckline opening 114 as shown in FIG. 2A to form a passage or opening 146 between a bottom margin 123 of the outer hood 126 and the neckline opening 114.

Figure 2B:
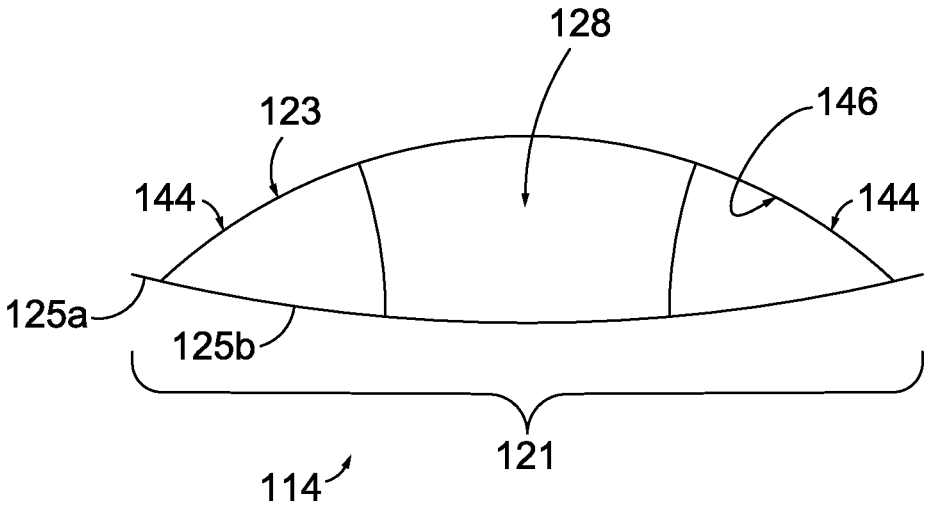
FIG. 2B illustrates a close-up view taken at the area indicated in FIG. 2A in accordance with aspects herein.

This aspect is shown in greater detail in FIG. 2B which illustrates a close-up view of the area indicated in FIG. 2A. As shown in FIG. 2B, a portion of the base 144 of the outer hood 126 is detached from or unaffixed to the back aspect 121 of the neckline opening 114 to form the opening 146. The portion at which the base 144 of the outer hood is affixed to the back aspect 121 of the neckline opening 114 may be referred to as a first location 125*a*, while the portion at which the base 144 of the outer hood is unaffixed to the back aspect 121 of the neckline opening 114 may be referred to as a second location 125*a*. To describe it another way, a portion of the bottom margin 123 of the outer hood 126 is unaffixed or detached from the neckline opening 114 along the back aspect 121 of the neckline opening 114 to form the opening 146. A portion of the yoke structure 128 is viewable through the opening 146 as will be explained in greater depth below.

Figure 3:
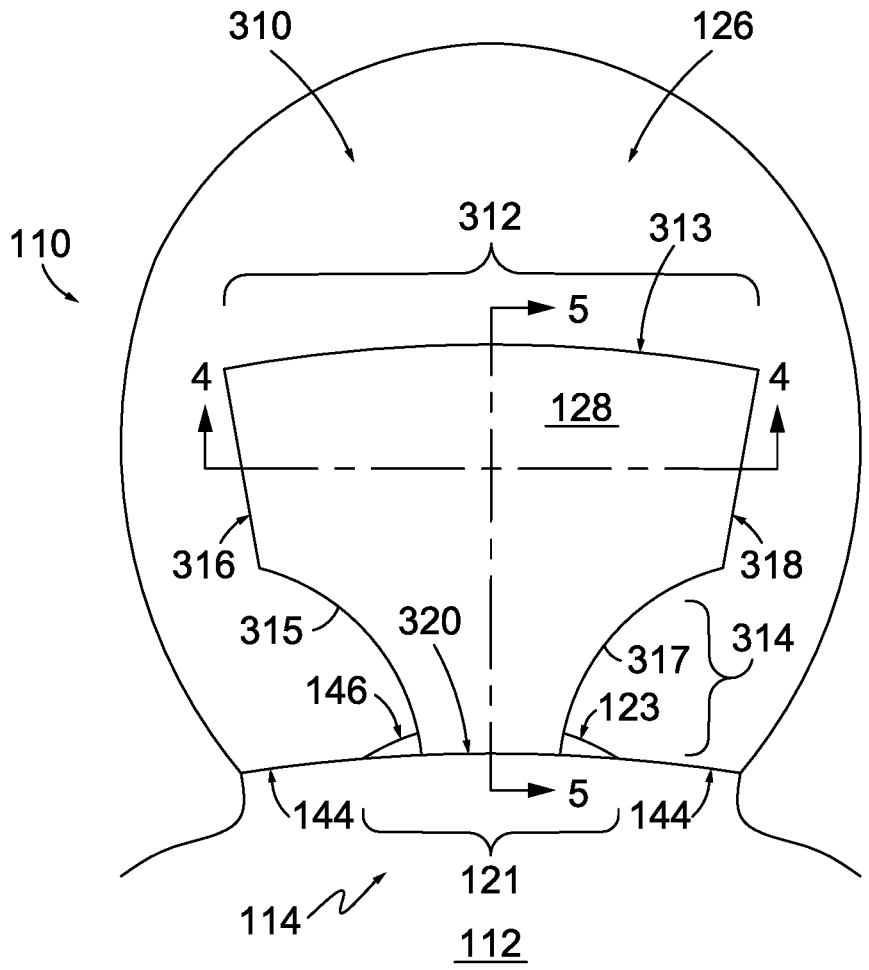
FIG. 3 illustrates an isolated front view of the exemplary hood system of FIGS. 1 and 2A in accordance with aspects herein.

Turning to FIG. 3, in accordance with aspects herein, a front view of the hood system 110 is illustrated with the outer hood 126 in an open state such that an inner-facing surface 310 of the outer hood 126 is more clearly visible along with the yoke structure 128. In exemplary aspects, the yoke structure 128 may be formed of an elastically resilient material such as a material with elastic yarns to provide two-way or four-way stretch to the yoke structure 128.

In exemplary aspects, the yoke structure 128 may assume generally a "T" shape with an arm portion 312 and a stem portion 314. The arm portion 312 may extend across the back of the outer hood 126 (e.g., from the first side portion 132, across the back portion 142, to the second side portion 134. The arm portion 312 may comprise a first terminal end 316 and a second terminal end 318 and may be defined by an upper margin 313. As used herein, the term "terminal" may be defined as the outermost portion of a structure. In exemplary aspects, the first terminal end 316 may be releasably or permanently affixed to the inner-facing surface 310 of the first side portion 132, and the second terminal end 318 may be releasably or permanently affixed to the inner-facing surface 310 of the second side portion 134 of the outer hood 126.

Continuing, the stem portion 314 extends from the arm portion 312 of the yoke structure 128 downwardly or inferiorly along the back portion 142 of the outer hood 126. The stem portion 314 may comprise a third terminal end 320 that is permanently or releasably affixed to the back aspect 121 of the neckline opening 114 of the garment 100. The stem portion may further comprise a first lateral edge 315 and a second lateral edge 317 that are unaffixed to the back portion 142 of the outer hood 126. In exemplary aspects, the point of attachment of the first, second, and third terminal ends 316, 318, and 320 of the yoke structure 128 to the outer hood 126 and the neckline opening 114 may comprise the only points of attachment of the yoke structure 128 to the garment 100. As such, remaining portions of the yoke structure 128 such as the arm portion 312 extending between the first and second terminal ends 316 and 318, and the stem portion 314, with the exception of the third terminal end 320, may be unaffixed or free-floating with respect to the outer hood 126. In accordance with aspects herein, the unaffixed or free-floating portions of the yoke structure 128 are at least partially bounded by the first lateral edge 315 and the second lateral edge 317, such that the stem portion 314 is unaffixed to the back portion 142 of the outer hood 126 with the exception of the third terminal end 320.

Figure 8:
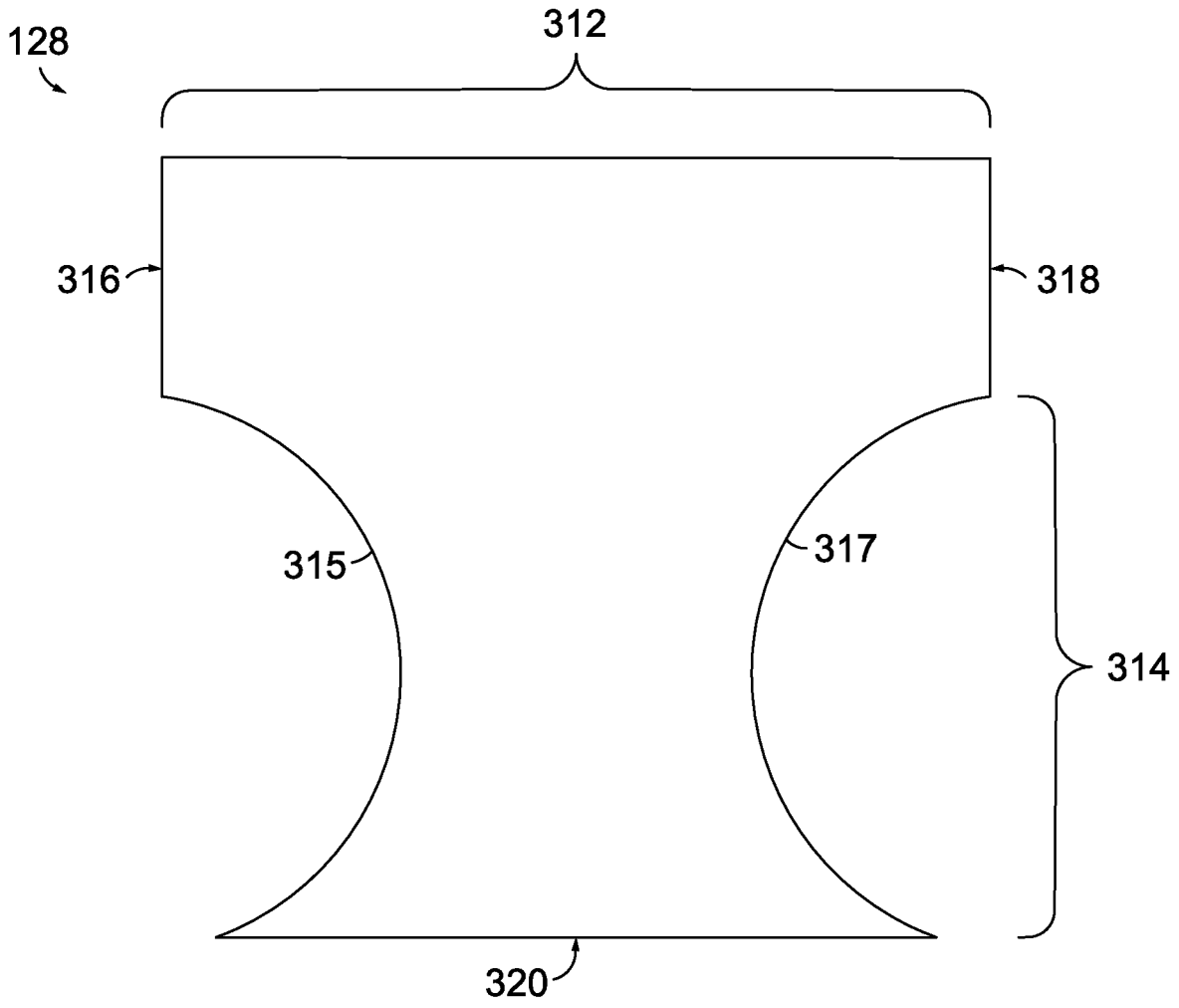
FIG. 8 illustrates an alternative shape configuration for an exemplary yoke structure in accordance with aspects herein.

The shape configuration shown for the yoke structure 128 in FIG. 3 is exemplary only. For example, and as shown in FIG. 8, the third terminal end 320 of the stem portion 314 of the yoke structure 128 may assume a flared shape as opposed to a more linear shape as shown in FIG. 3. Any and all aspects, and any variation thereof, are contemplated as being within aspects herein.

Figure 4:
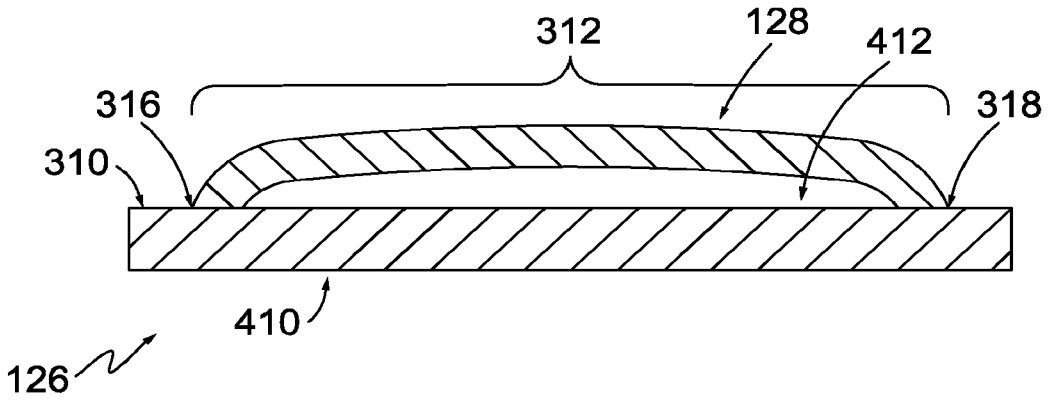
FIG. 4 illustrates a cross-sectional view taken along cut line 4-4 of FIG. 3 in accordance with aspects herein.
Figure 5:
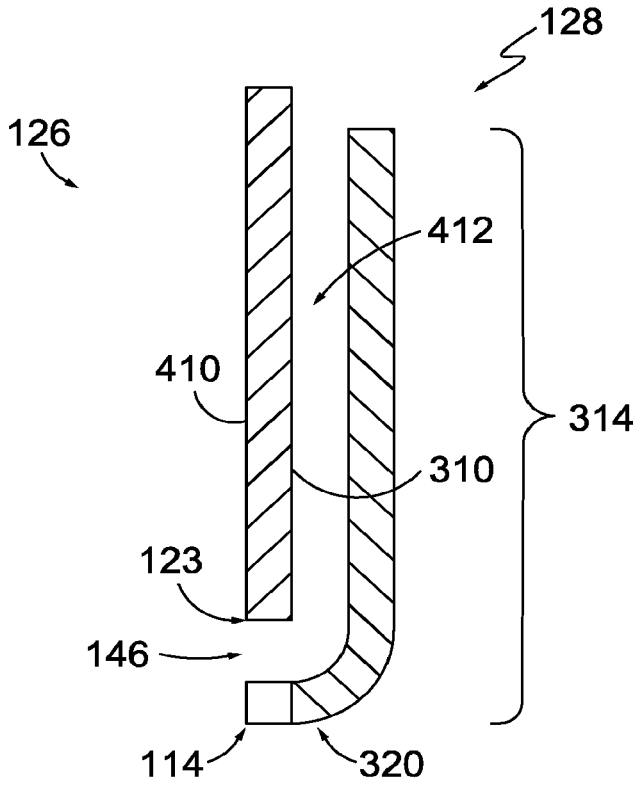
FIG. 5 illustrates a cross-sectional view taken along cut line 5-5 of FIG. 3 in accordance with aspects herein.

Turning now to FIGS. 4 and 5, FIG. 4 is a cross-sectional view taken along cut line 4-4 of FIG. 3, and FIG. 5 is a cross-sectional view taken along cut line 5-5 of FIG. 3 in accordance with aspects herein. With respect to FIG. 4, the outer hood 126 is shown with the inner-facing surface 310 and an outer-facing surface 410. The arm portion 312 of the yoke structure 128 is shown with the first and second terminal ends 316 and 318 affixed to the inner-facing surface 310 of the outer hood 126. However, the segment of the arm portion 312 extending between the first and second terminal ends 316 and 318 is unaffixed or detached from the inner-facing surface 310 of the outer hood 126 to define a space 412 between the yoke structure 128 and the outer hood 126.

With respect to FIG. 5, the stem portion 314 of the yoke structure 128 is shown unaffixed or detached from the outer hood 126 to further define the space 412. The third terminal end 320 of the yoke structure 128 is shown affixed to the neckline opening 114. The opening 146 is also illustrated in FIG. 5, where the opening 146 is formed at the region where the bottom margin 123 of the outer hood 126 is unaffixed to or detached from the neckline opening 114 of the garment 100.

By having the yoke structure 128 be selectively affixed to the outer hood 126 at only the first and second terminal ends 316 and 318 and affixed to the neckline opening 114 of the torso covering portion 112 of the garment 100 via the third terminal end 320, the yoke structure 128 can achieve several different functions. For instance, this configuration helps to at least partially "de-couple" the yoke structure 128 from the outer hood 126 so that the outer hood 126 may be positioned or moved somewhat independently of the yoke structure 128. For instance, the top portion 136 of the outer hood 126 may be pulled forward to cover a wearer's eyes when the wearer wishes to rest or sleep without causing undue tension on the neckline opening 114 of the garment 100 and while still maintaining a snug fit to the hood system 110 through use of the yoke structure 128.

Figure 6:
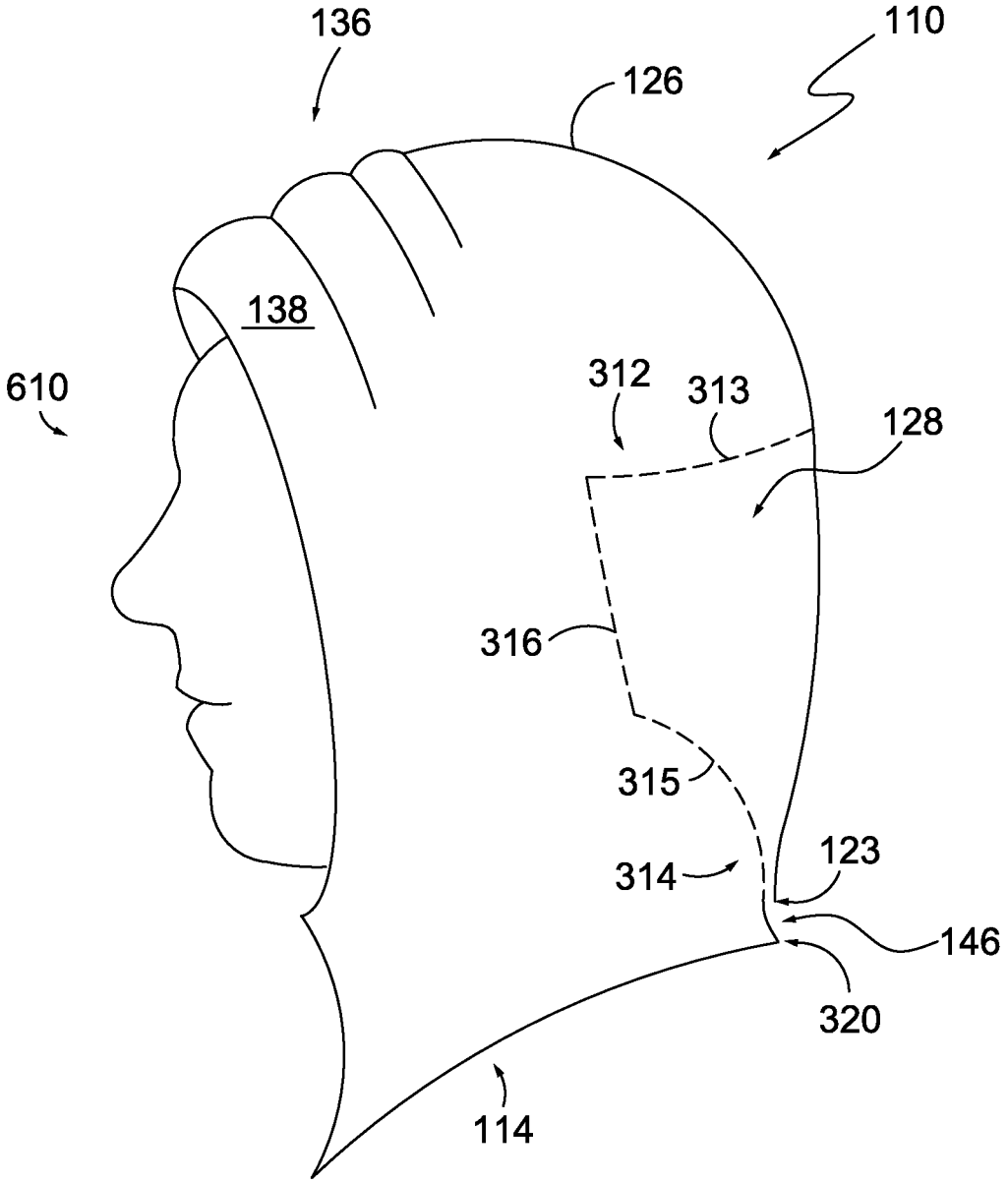
FIG. 6 illustrates a first side view of the exemplary hood system when the outer hood is in a head covering position but in an un-tensioned state in accordance with aspects herein.

More particularly, FIG. 6 illustrates a side view of a wearer 610 wearing the hood system 110 of the garment 100 in accordance with aspects herein. The outer hood 126 is shown in a head covering position with the wearer's eyes uncovered (this may be known herein as the outer hood 126 being in an "un-tensioned state"). As shown, because the top portion 136 of the outer hood 126 may be constructed to have extra volume, the top portion 136 may present one or more folds when the outer hood 126 is in the un-tensioned state. The yoke structure 128 (shown by dashed lines to indicate that it is hidden from external view) is generally positioned on the back aspect of the wearer's head and is maintained in this position via the attachment of the first and second terminal ends 316 and 318 to the outer hood 126. The lower or bottom margin 123 of the outer hood 126 is shown detached from the neckline opening 114 although the third terminal end 320 of the yoke structure 128 is affixed to the neckline opening 114 at the location where the outer hood 126 is detached. Because the outer hood 126 is in an un-tensioned state, the lower or bottom margin 123 of the outer hood 126 is positioned adjacent (e.g., within about 5 mm to about 2 cm) of the neckline opening 114. As used herein, the term "about" may mean within ±10% of a designated value.

Figure 7:
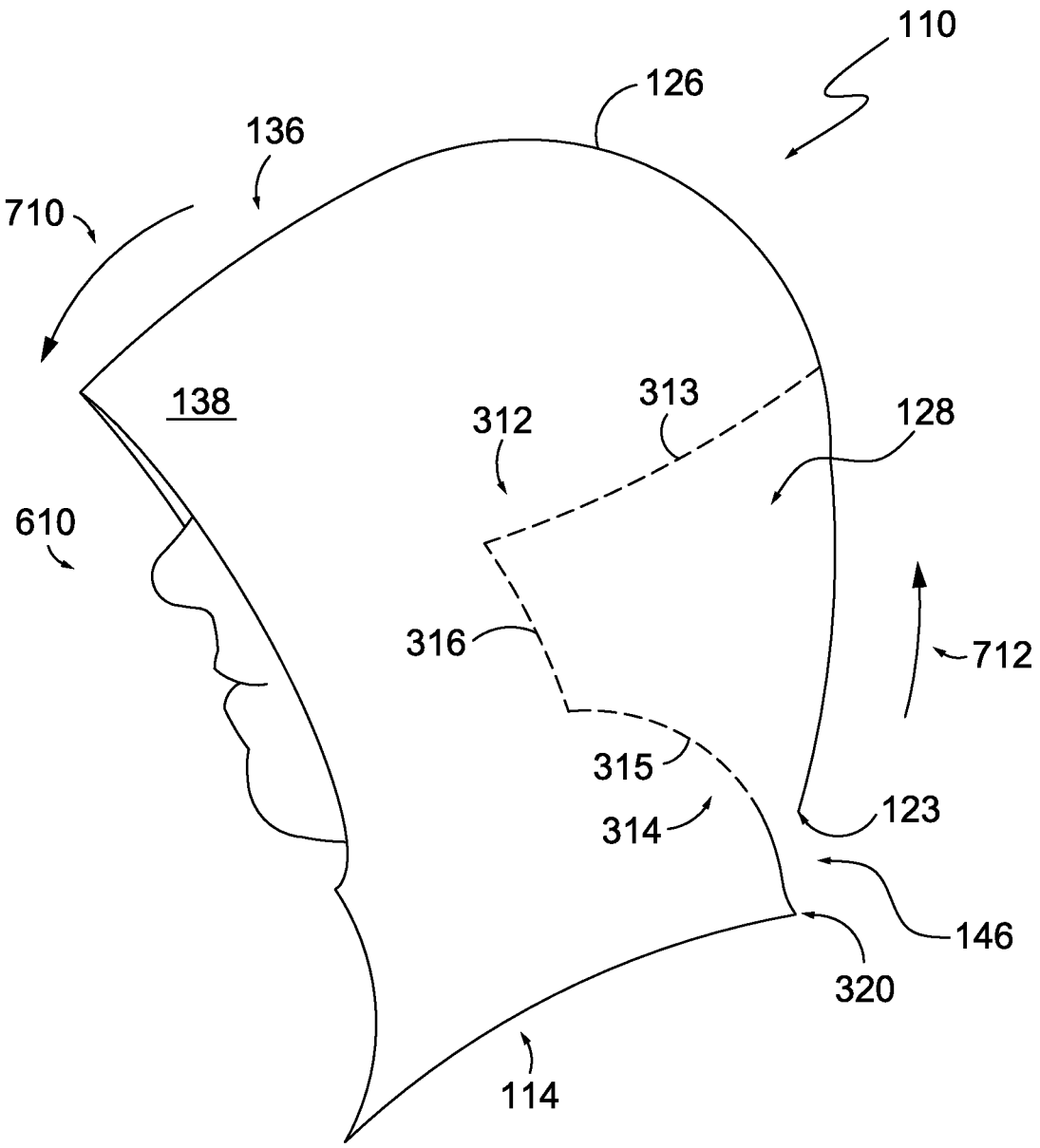
FIG. 7 illustrates a second side view of the exemplary hood system when the outer hood is in the head covering position and tensioned in an anterior or forward direction in accordance with aspects herein.

FIG. 7 illustrates a side view of the wearer 610 with the front aspect 138 of the top portion 136 of the outer hood 126 pulled forward to at least partially cover the wearer's eyes (known herein as the outer hood 126 being in a "tensioned state"). This movement is indicated by the arrow 710. In exemplary aspects, the movement 710 may be at least partially facilitated by constructing the top portion 136 of the outer hood 126 to have an extra volume of material as compared to more traditional hood constructions. When pulled forward, the bottom margin 123 of the outer hood 126, since it is detached from the neckline opening 114, may be pulled superiorly away from (or further spaced apart from) the neckline opening 114 of the garment 100, thereby increasing the size of the opening 146. This is indicated by the arrow 712. The detachment of the bottom margin 123 of the outer hood 126 from the neckline opening 114 thus helps to minimize undue or unwanted tension at the back aspect 121 of the neckline opening 114 when the outer hood 126 is pulled forward.

Due to the selective attachment of the first, second, and third terminal ends 316, 318, and 320 of the yoke structure 128, the yoke structure 128 may act to anchor at least the back portion 142 and the side portions 132, 134 of the outer hood 126 when the top portion 136 of the outer hood 126 is tensioned forward. To describe it a different way, the top portion 136 of the outer hood 126 may be pulled forward without causing significant displacement of other portions of the outer hood 126 due to the anchoring function of the yoke structure 128. And due to the elastic characteristics of the yoke structure 128, the arm portion 312 and the stem portion 314 of the yoke structure 128 may expand to cover more of the posterior or back aspect of the wearer's head when the outer hood 126 is tensioned forward. But because the stem portion 314 is affixed to the neckline opening 114, the yoke structure 128 is prevented from becoming displaced anteriorly. In other words, the attachment of the third terminal end 320 to the neckline opening 114 helps to maintain the arm portion 312 of the yoke structure 128 positioned against the back and crown of the wearer's head instead of being pulled forward onto the front aspect of the wearer's head with the movement of the outer hood 126. Moreover, although the stem portion 314 of the yoke structure 128 may elongate or stretch when the outer hood 126 is in the tensioned state, the elastic nature of the yoke structure 128 minimizes the tension applied to the neckline opening 114 of the garment 100. The result is that the wearer 610 experiences a snug fit even in situations where the outer hood 126 is constructed to have extra volume. Moreover, the minimization of tension imparted to the neckline opening 114 further enhances wearer comfort.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A garment having a hood system, the garment comprising:

at least a torso portion having a neckline opening, and an outer hood, wherein the torso portion and the outer hood are coupled at the neckline opening of the torso portion, the outer hood comprising:

at least a first side portion and a second side portion, a top portion adjacent to the first side portion and the second side portion, the top portion having a front aspect and a back aspect, and a back portion extending from the back aspect of the top portion and extending from the first side portion to the second side portion, the back portion, the first side portion, and the second side portion defining a base of the outer hood, wherein the base of the outer hood is affixed to the neckline opening of the torso portion at a first location and is unaffixed from the neckline opening of the torso portion at a second location; and a yoke structure positioned adjacent and internal to the outer hood, the yoke structure having a first portion having a first terminal end, a second portion having a second terminal end, a third portion having a third terminal end, a first lateral edge extending between the first terminal end and the third terminal end, and a second lateral edge extending between the second terminal end and the third terminal end, wherein the third terminal end of the yoke structure is affixed to the neckline opening of the torso portion at the second location, wherein the yoke structure is further affixed to the first side portion of the outer hood at the first terminal end and the second side portion of the outer hood at the second terminal end, and further wherein the first lateral edge and the second lateral edge are unaffixed from the outer hood; and wherein the yoke structure forms a "T" shape with the third portion of the yoke structure forming a stem portion of the "T" and the first portion and the second portion of the yoke structure forming an arm portion of the "T."

2. The garment of claim 1, wherein the neckline opening of the torso portion is defined by at least a first side aspect, a second side aspect, and a back aspect.

3. The garment of claim 2, wherein the first location at which the base of the outer hood is affixed to the neckline opening of the torso portion comprises at least one of the first side aspect or the second side aspect of the neckline opening.

4. The garment of claim 3, wherein the second location at which the base of the outer hood is unaffixed from the neckline opening of the torso portion comprises the back aspect of the neckline opening.

5. The garment of claim 4, wherein the first, second, and third portions of the yoke structure integrally extend from one another.

6. The garment of claim 1, wherein the yoke structure is unaffixed to the outer hood except for at the first side portion of the outer hood and the second side portion of the outer hood.

7. The garment of claim 1, wherein the outer hood is formed from a non-stretch material.

8. The garment of claim 7, wherein the yoke structure is formed from an elastically resilient material.

9. A garment having a hood system, the garment comprising:

a torso covering portion having at least a neckline opening;

an outer hood having a base which is at least partially affixed to the neckline opening at a first location and is unaffixed from the neckline opening at a second location, the outer hood further comprising a first side portion and a second side portion; and a yoke structure positioned adjacent and internal to the outer hood, the yoke structure having a first portion having a first terminal end, a second portion having a second terminal end, a third portion having a third terminal end, a first lateral edge extending between the first terminal end and the third terminal end, and a second lateral edge extending between the second terminal end and the third terminal end, wherein the third terminal end of the yoke structure is affixed to the neckline opening at the second location, wherein the first terminal end of the yoke structure is further affixed to the outer hood at the first side portion of the outer hood, and further wherein the second terminal end of the yoke structure is affixed to the outer hood at the second side portion of the outer hood; and wherein the first lateral edge and the second lateral edge are unaffixed from the outer hood; and wherein the yoke structure forms a "T" shape with the third portion of the yoke structure forming a stem portion of the "T" and the first portion and the second portion of the yoke structure forming an arm portion of the "T."

10. The garment of claim 9, wherein the neckline opening at least partially defines a circumferential opening having a front aspect, a first side aspect, a second side aspect, and a back aspect when the garment is in an as-worn configuration.

11. The garment of claim 9, wherein the first side portion and the second side portion are positioned on opposite sides of the outer hood.

12. The garment of claim 9, wherein the yoke structure is unaffixed to the outer hood except for at the first terminal end and the second terminal end of the yoke structure.

13. The garment of claim 9, wherein the outer hood is formed from a non-stretch material and the yoke structure is formed from an elastically resilient material.

14. A garment having a hood system, the garment comprising:

at least a torso portion having a neckline opening, and an outer hood, wherein the outer hood is affixed to the neckline opening of the torso portion at a first location and is unaffixed from the neckline opening of the torso portion at a second location; and a yoke structure positioned adjacent and internal to the outer hood, the yoke structure having a first portion having a first terminal end that is affixed to a first side portion of the outer hood, a second portion having a second terminal end affixed to a second side portion of the outer hood, and a third portion having a third terminal end affixed to the neckline opening of the torso portion at the second location, wherein the yoke structure further comprises a first lateral edge extending between the first terminal end and the third terminal end, and a second lateral edge extending between the second terminal end and the third terminal end, each of the first lateral edge and the second lateral edge being unaffixed from the outer hood; and wherein the yoke structure forms a "T" shape with the third portion of the yoke structure forming a stem portion of the "T" and the first portion and the second portion of the yoke structure forming an arm portion of the "T."

15. The garment of claim 14, wherein the first portion, the second portion, and the third portion of the yoke structure integrally extend from one another.

16. The garment of claim 15, wherein the yoke structure is detached from the outer hood except at the first side portion and the second side portion of the outer hood.

17. The garment of claim 14, wherein the first location of the neckline opening comprises a first side aspect and a second side aspect of the neckline opening, and wherein the second location of the neckline opening comprises a back aspect of the neckline opening.

* * * * *